US008279064B2

(12) United States Patent
Sansone et al.

(10) Patent No.: US 8,279,064 B2
(45) Date of Patent: Oct. 2, 2012

(54) METHOD FOR POSTAGE EVIDENCING FOR THE PAYMENT OF TERMINAL DUES USING RADIO FREQUENCY IDENTIFICATION TAGS

(75) Inventors: Ronald P. Sansone, Weston, CT (US); Erik Monsen, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 1199 days.

(21) Appl. No.: 10/673,794

(22) Filed: Sep. 29, 2003

(65) Prior Publication Data

US 2005/0067486 A1 Mar. 31, 2005

(51) Int. Cl.

| | |
|---|---|
| ***G08B 13/14*** | (2006.01) |
| ***G06F 17/00*** | (2006.01) |
| ***G07B 17/02*** | (2006.01) |
| ***G06K 5/00*** | (2006.01) |

(52) U.S. Cl. ..... 340/572.1; 705/401; 235/380

(58) Field of Classification Search ..... 340/572.1, 340/5.2, 5.42, 5.41, 5.4; 705/401–411; 283/71; 700/226, 228, 236; 235/380

See application file for complete search history.

(56) References Cited

U.S. PATENT DOCUMENTS

| | | | | |
|---|---|---|---|---|
| 4,999,481 | A | 3/1991 | Baer et al. | 235/375 |
| 5,459,670 | A * | 10/1995 | Johnson et al. | 700/224 |
| 5,554,842 | A | 9/1996 | Connell et al. | 235/491 |
| 5,612,889 | A | 3/1997 | Pintsov et al. | 364/478.14 |
| 5,978,781 | A | 11/1999 | Sansone | 705/408 |
| 6,130,613 | A * | 10/2000 | Eberhardt et al. | 340/572.7 |
| 6,526,393 | B1 | 2/2003 | Fredman | 705/408 |
| 6,701,304 | B2 * | 3/2004 | Leon | 705/401 |
| 6,741,178 | B1 * | 5/2004 | Tuttle | 340/572.1 |
| 6,865,558 | B1 | 3/2005 | Pierce et al. | 705/60 |
| 6,978,248 | B1 | 12/2005 | Walker et al. | 705/10 |
| 7,058,581 | B1 | 6/2006 | Young | 705/1 |
| 7,120,610 | B1 | 10/2006 | Brookner et al. | 705/401 |
| 2003/0009351 | A1 | 1/2003 | Wade | 705/1 |
| 2003/0014375 | A1 * | 1/2003 | Hoffmann et al. | 705/404 |
| 2003/0115162 | A1 | 6/2003 | Konick | 705/404 |
| 2004/0012496 | A1 * | 1/2004 | De Souza et al. | 340/572.3 |
| 2004/0215480 | A1 | 10/2004 | Kadaba | 705/1 |

* cited by examiner

*Primary Examiner* — Jennifer Mehmood

(74) *Attorney, Agent, or Firm* — Steven J. Shapiro; Charles R. Malandra, Jr.

(57) ABSTRACT

The invention makes it easier for the post office to calculate accurately terminal dues by providing information to the post regarding each piece or parcel of mail that crosses an international border. The invention also makes it easier for the post offices to calculate terminal dues by obtaining fee information from mail that is sent internationally. The foregoing is accomplished by placing an indication on the mail that the fees for delivering the mail have been paid or will be paid by a mailer to each post office that handles the mail. For instance, if a mail piece is mailed in the United States and delivered to a destination in the United Kingdom, the mailer's postage meter will place a Radio Frequency Identification Tag (RFID) on the mail piece that indicates the portion of the delivery cost that is attributable to the United States post office and that portion of the delivery cost that is attributable to the Royal Mail.

9 Claims, 5 Drawing Sheets

METHOD FOR POSTAGE EVIDENCING FOR THE PAYMENT OF TERMINAL DUES USING RADIO FREQUENCY IDENTIFICATION TAGS

CROSS REFERENCE TO RELATED APPLICATIONS

Reference is made to commonly assigned copending patent application Ser. No. 10/674,135 filed Sep. 29, 2003, entitled "Method For Postage Evidencing For The Payment Of Terminal Dues" in the names of Erik Monsen, Ian A. Siveyer, Marc Morelli, Yakup J. Igval, John C. Harmon and Ronald P. Sansone; and copendinq patent application Ser. No. 10/674,134 filed Sep. 29, 2003, entitled "Method For Postage Evidencing With Cross-Border Mail Tracking Capability And Near Real Time For Terminal Dues Reconciliation" in the names of Ronald P. Sansone and Erik Monsen; and copendinq patent application Ser. No. 10/674,133 filed Sep. 29, 2003, entitled "Integrated Payment For International Business Reply Mail" in the names of Douglas B. Quine, Ronald P. Sansone, and Erik D. N. Monsen.

FIELD OF THE INVENTION

The invention relates generally to the field of mailing systems and, more particularly, to methods for determining terminal dues.

BACKGROUND OF THE INVENTION

The Universal Postal Union has a complex system that administers contracts between member post offices relating to terminal dues paid between and among different post offices. Terminal dues are the payments made between national postal administrations to cover the costs of handling and delivering international mail. Rates are established by the Universal Postal Union and through bilateral and multilateral agreements. Typically, a post office will charge another post office for the delivery of mail to a recipient within its jurisdiction. For instance, if mail is sent from the United States to the United Kingdom, the United States post office will deliver the mail to the Royal Mail, and the Royal Mail will deliver the mail to the recipient. At the end of a predetermined time, the United States post office and the Royal Mail will tabulate, by weight, all of the mail each post office delivered for the other post office and calculate how much money one post office owes to the other post office.

One of the disadvantages of the above procedure is that it does not accurately determine the services performed by each post office.

An additional disadvantage of the prior art is that each post office was not sure that it was receiving the proper amount of money for the services it was performing A further disadvantage of the prior art is that mail did not have an indication of the value of the services produced by different post offices.

SUMMARY OF THE INVENTION

This invention overcomes the disadvantages of the prior art by making it easier for the various post offices to calculate accurately terminal dues by providing information to the post office regarding each piece or parcel of mail that crosses an international border. The invention also makes it easier for the post offices to calculate terminal dues by obtaining fee information from mail that is sent internationally.

The foregoing processes are accomplished by placing an indication on the mail that the fees for delivering the mail have been paid or will be paid by a mailer to each post office who handles the mail. For instance, if a mail piece is mailed in the United States and delivered to a destination in the United Kingdom, the mailer's postage meter will place a Radio Frequency Identification Tag ("RFID") on the mail piece that indicates the portion of the delivery cost that is attributable to the United States post office, and that portion of the delivery cost that is attributable to the Royal Mail.

An advantage of this invention is that it provides more accurate reporting and checking of the amount of international mail. Thus, each post office receives the correct revenue for the amount of mail that it processes.

DETAILED DESCRIPTION OF THE PREFERRED EMBODIMENT

Figure 1:
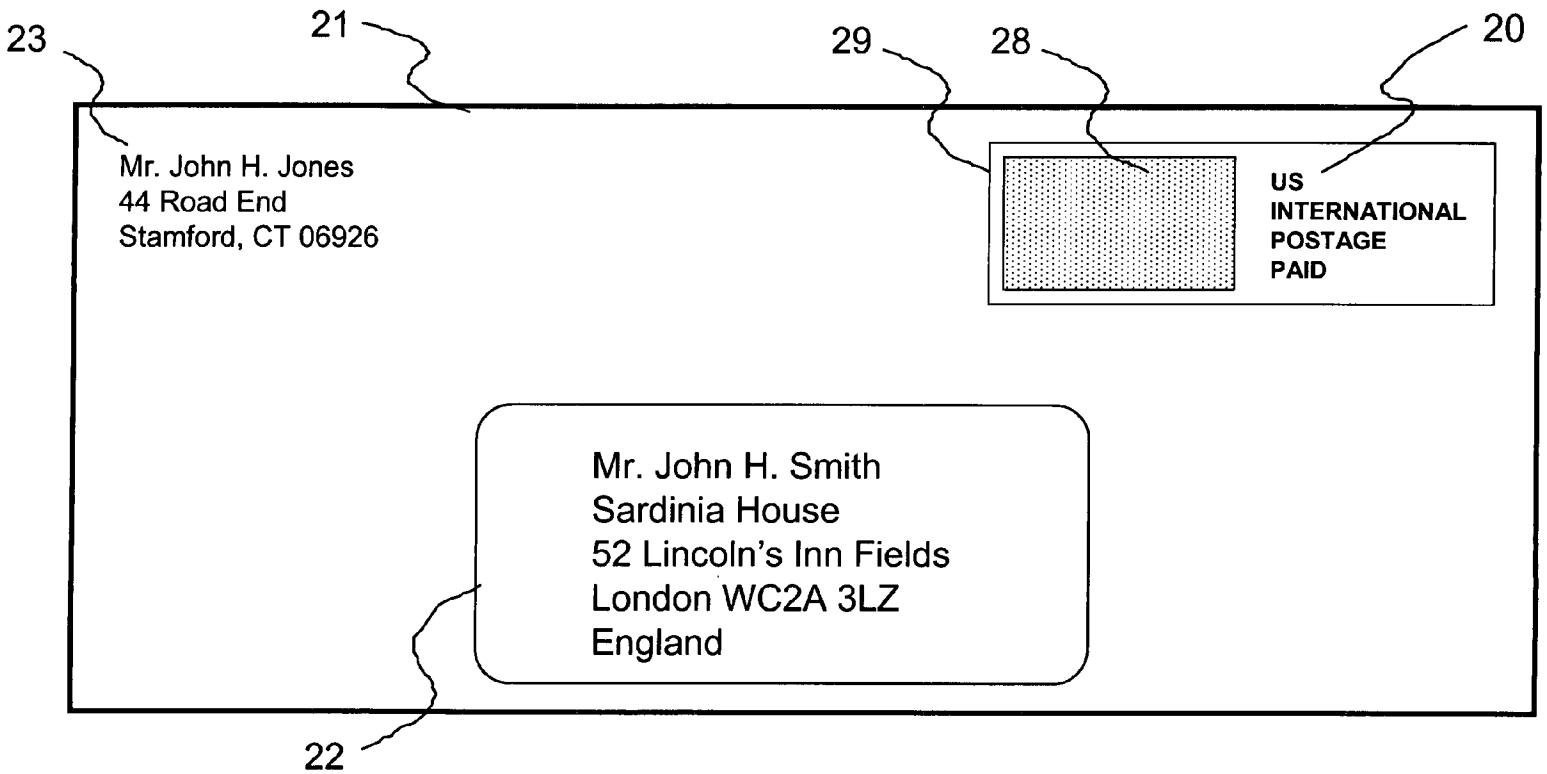
FIG. 1 is a drawing of mail containing a radio frequency tag postal indicia.

Referring now to the drawings in detail, and more particularly to FIG. 1, the reference character 21 represents mail, i.e., letter, flat, package, that has a recipient address field 22, a sender address field 23, and a label 29. Label 29 includes a radio frequency identification tag 28 and written material 20 that indicates United States international postage has been paid. Tag 28 contains a memory that stores the price for United States postage; the price for United Kingdom postage; the date that tag 28 was affixed to mail 21; the place from which mail 21 was mailed; a postage meter number that accounts for tag 28; mail classification, i.e., first class, requested special services, a unique number that uniquely defines mail 21, the weight of the mail, the contents of the mail, the recipient's name and address including foreign countries postal code, and the sender's name and address including zip code.

Figure 2:
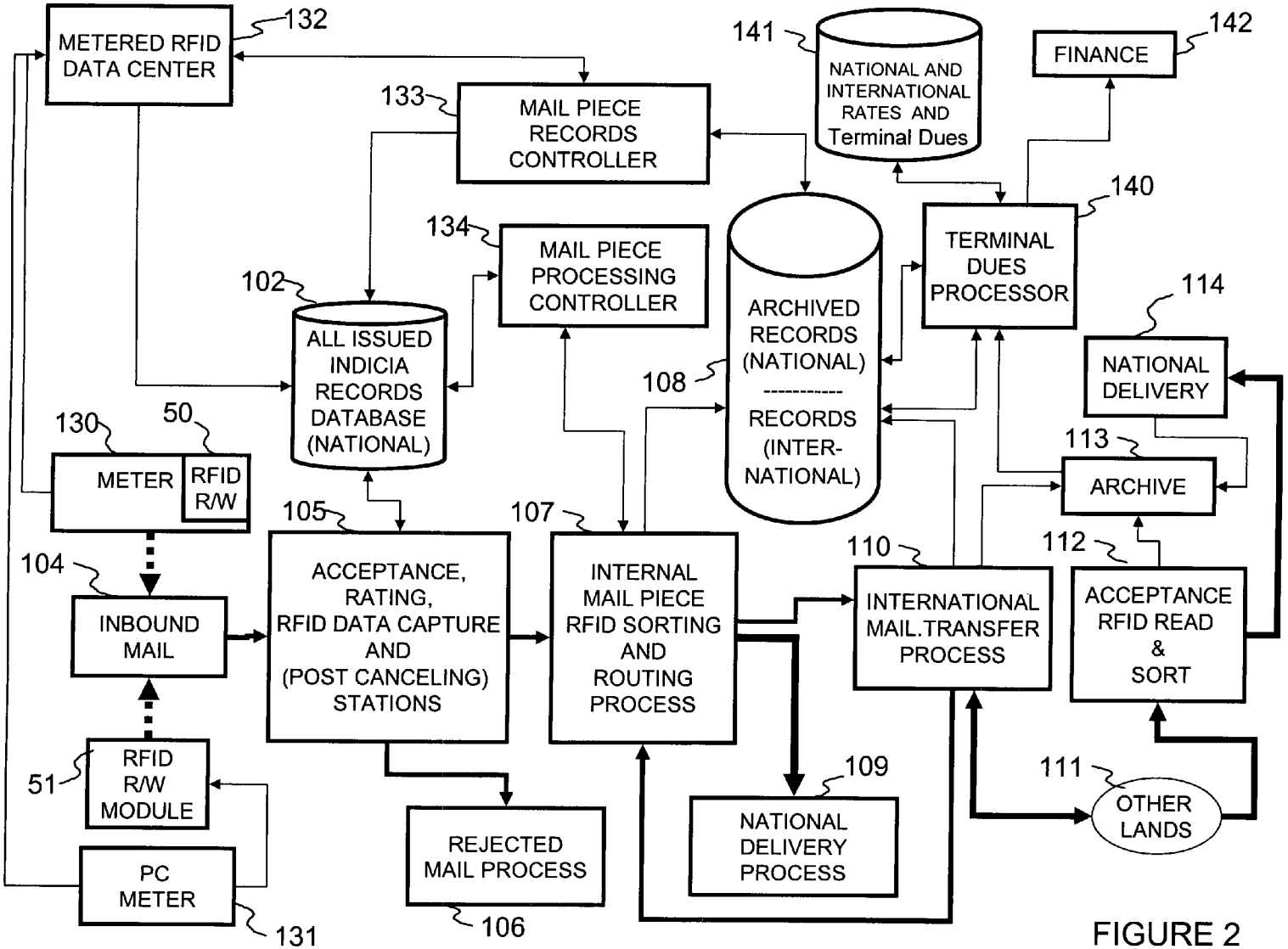
FIG. 2 is a block diagram illustrating the process of metering international mail so that terminal dues will be paid.

FIG. 2 is a block diagram illustrating the process of metering international mail so that terminal dues will be paid. Electronic postage meter 130 that contains a RFID read/write head 50 or personal computer meter 131 that contains a read/write head 51 may be used to write a unique number 19 (FIG. 4) and other information into tag 28 (FIG. 1). During a communication between postage meter 130 or personal computer meter 131 with data center 132, it will be indicated that meter 130 or meter 131 wrote information into tag 28 including a unique number 19. The operation of meters 130 and 131 will be described in the description of FIG. 3. Mail records controller 133 will transmit the information it receives from data center 132 to data base 102, where a record is created, specifically referenced to the issued unique number 19 for a particular meter 130 or 131 account number. The record is a proof of validity of tag 28 that issued unique number 19 for a particular meter, and the proof is provided when data base 102 is consulted.

Postal terminal dues processor 140 is coupled to archive 108, national, international and terminal dues data base 141, finance 142 and archives 108 and 113. Processor 140 will poll archive 108 and archives 113 in other lands 111 (United Kingdom, France, German, Japan, etc.) and utilize data base 141 to determine the value of the mail processed by the receiving countries from the sending countries. Then processor 140 will determine how much money each country will receive for delivering mail 21. The amounts of money will be described in the description of FIG. 4. At agreed upon intervals, finance 142 will issue terminal dues statements to all participating countries and arrange for the transmission of funds to the countries Post Offices.

In step 104, the mail is collected and rated at various post office recording stations using data capture techniques and processed by the accepting post office in step 105. As part of the mail accepting procedures in step 105, the information in tag 28 including unique number 19 are examined and compared to data in data base 102, to determine whether the information in tag 28 and unique number 19 used are legitimate. When unique number 19 is issued for tag 28, the issuance of unique number 19 is reported to the "all issued indicia records national data base" 102, where a record is created, capturing the issued unique number 19 for a particular mailer account number. The record is a proof of validity of postal indicia 20 and 31 having an issued unique number for a particular mailer account number, and the proof is provided when data base 102 is consulted.

In the acceptance process, a code reader is used to identify the unique number 19 and other information recorded in tag 28. The tag 28 and unique number 19 is reported to data base 102, and a proof of validity of tag 28 and unique number 19 is requested. If data base 102 has a record showing the issuance of the unique number 19 for the particular meter account serial number used and that the unique number 19 has not been canceled, then tag 28 is considered legitimate. In that case, tag 28 has passed the verification process, and the mail is accepted for further processing, with tag 28 being canceled in step 105. It is preferred that the cancellation mark be produced with a visible ink and in an electronically readable format in a manner that a "canceled" tag 28 is easily distinguishable from an unused one, and that a "cancelled" postal indicator" will appear on label 29 and in tag 28.

When tag 28 bearing a unique number 19 for a particular user meter account serial number is canceled in step 105, a request is made to data base 102 to alter the record that is specifically related to the unique number 19 being canceled. The altered record will contain the date and time of cancellation, the cost of the selected services derived from the weighing of the mail, and no longer provide a proof of validity when data base 102 is consulted. The cost for mailing the mail determined in step 105 will be charged to the mailer's meter account 130 or 131. The mailer cost information will be transmitted to data center 132 via data base 102 and controller 133.

However, if the acceptance procedures in step 105 fail to yield a proof of validity of tag 28, the mail will be sent to rejected mail process 106 where the mail will be returned to the sender or placed in the dead mail file.

The mail that step 105 determines has legitimate tags 28 are sent to step 107 for internal sorting and routing from place to place. Step 107 will note the date and time the mail is at each step in the process. The foregoing information will be sent to archive 108. Then the physical mail is delivered nationally in step 109 or delivered internationally in step 110. Nationally, at the recipient's delivery post office, the mail will be scanned during the last sorting process where the date and time of sorting as well as other information identifying the mail, i.e., unique number 19, will be captured and stored in archive 108. At the last facility before the mail is transferred internationally in step 110, the mail will be scanned where the date and time of sorting as well as other information identifying the mail, i.e., unique number, will be captured and stored in archive 108.

At this point, the physical mail will be delivered to other lands 111. Then the mail will go to step 112 for sorting, routing and acceptance in the country that the recipient is located. Step 112 will note the date and time the mail is at each step in the process. The foregoing information will be sent to archive 113. Then the physical mail is delivered nationally in step 114. At the international recipient's delivery post office, the mail will be scanned during the last sorting process where the date and time of sorting as well as other information identifying the mail, i.e., unique number, will be captured and stored in archive 113.

Figure 3:
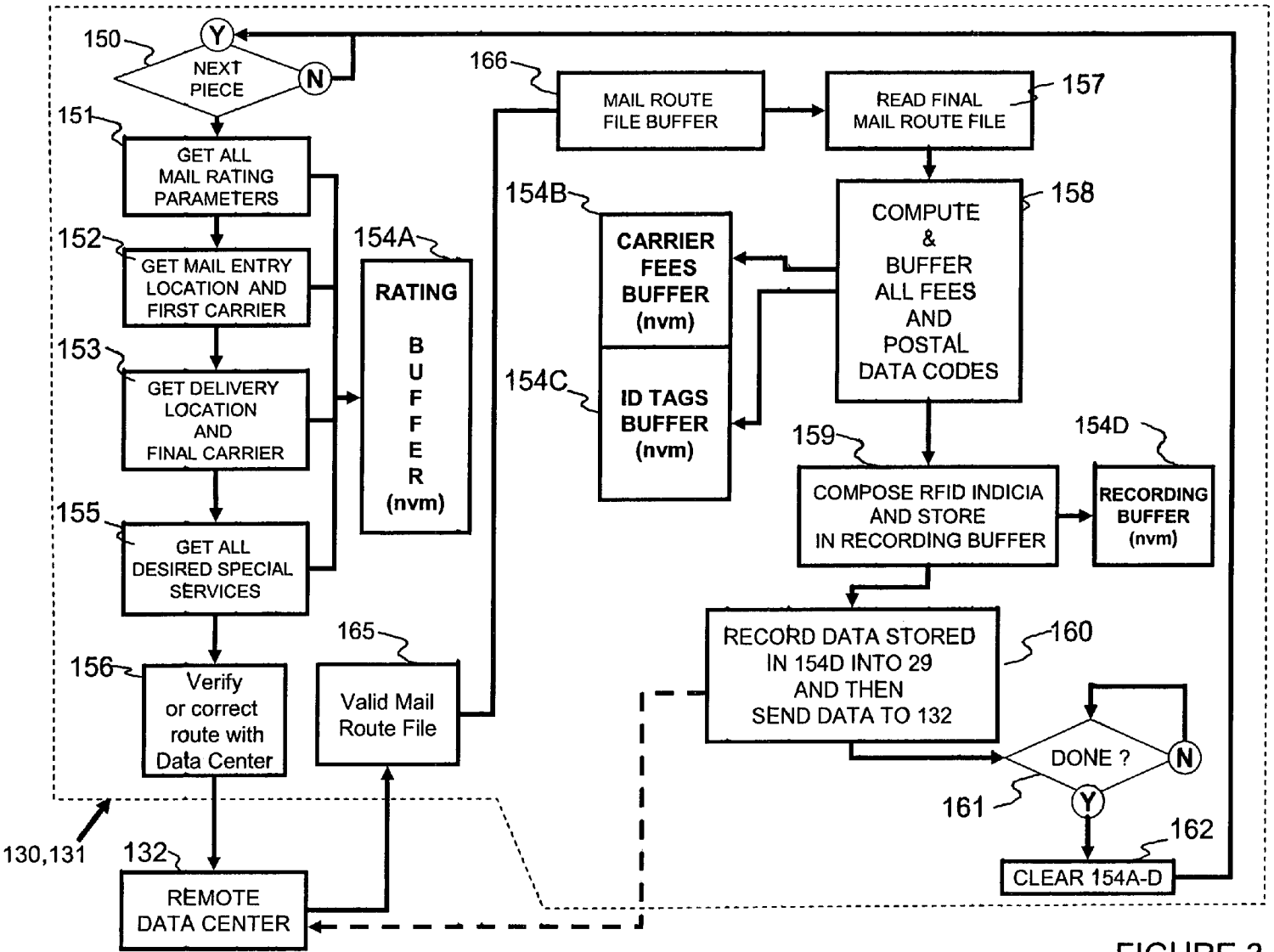
FIG. 3 is a block diagram of postage meter 130 or personal computer meter 131 of FIG. 2.

FIG. 3 is a block diagram of postage meter 130 or personal computer meter 131 of FIG. 2. The first step takes place at decision block 150. Decision block 150 determines whether or not the next mail is present. If block 150 determines that the next mail is not present, the next step will be step 162. Step 162 clears buffers 154A-154D. If block 150 determines that the next mail is present, the next step will be step 151. Step 151 obtains all mail rating parameters, from the operator of meters 130 or 131 and/or another external source, i.e., how much does the mail weigh, the size of the mail, where is the mail going, what is the level of mail service, the contents of the mail, etc., and places them in buffer 154A. Next, in step 153, the delivery location of the mail and the final carrier is obtained from the operator of meters 130 or 131 and/or another external source and stored in buffer 154A. Then in step 155, all desired special services are obtained the operator of meters 130 or 131 and/or another external source are stored in buffer 154A. In step 156, the correct route and fees are verified with data center 132, i.e., the information obtained from buffer 154A is verified with remote data center 132.

Step 165 stores the valid mail route and fees file it receives from data center 132 and then transmits the valid mail route and fees file to buffer 166. Step 157 reads the valid mail route and fees file in buffer 166. Step 158 takes the valid mail route and fees file and computes and buffers all fees and carrier information with buffers 154B and 154C, i.e., the total fee for mail 20 (FIG. 1A) would be $4.70 with $2.20 payable to the Royal Mail and $2.50 going to the United States Postal Service. It would be obvious to one skilled in the art that the payment to the Royal Mail may be made in United States Dollars or United Kingdom currency at the prevailing exchange rate. Step 159 composes the full indicia in route, sequenced order and stores the above information in recording non volatile memory buffer 154D. In step 160 the information stored in buffer 154D is written into tag 28 on mail 20, and then the recorded information is sent to data center 132. The next step is performed by decision block 161. Decision block 161 determines whether or not the information stored in buffer 154D has been written into tag 28 on mail 20 and whether or not the written information has been sent to data center 132. If the information stored in buffer 154D has not been sent to data center 132, the process will go back to the input of decision block 161. If the information stored in buffer 154D has been written into tag 28 on mail 20 and the information stored in buffer 154D has been sent to data center 132, buffers 154A-154D and 166 will be cleared, and the next step will be performed by decision block 150.

Figure 4:
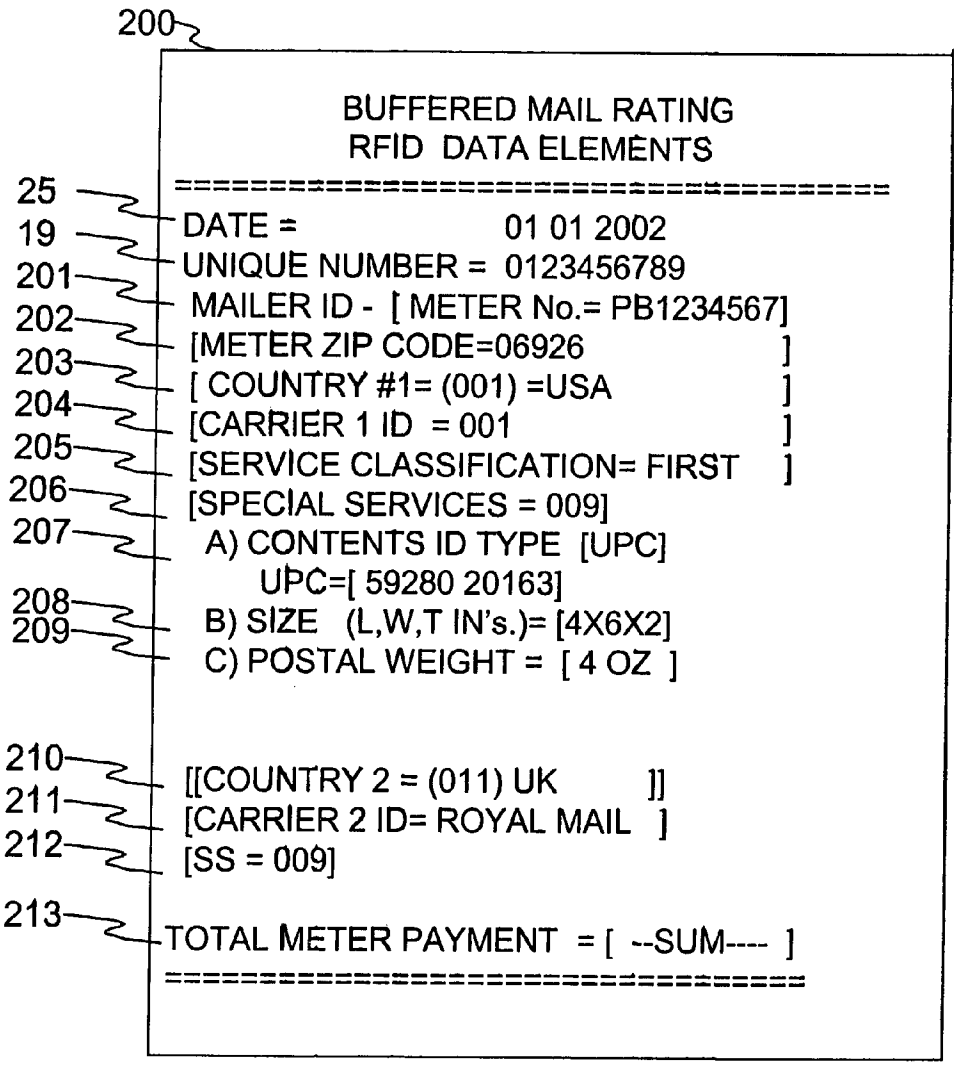
FIG. 4 is a drawing of the information stored in buffer 154A.

FIG. 4 is a drawing of the information stored in buffer 154A (FIG. 3) as buffered mail rating radio frequency identification data elements 200. Item 201 indicates the mailer identification, i.e., the mailer postage meter serial number PB 1234567. Item 202 indicates the zip code in which the meter is registered, namely 06926. Item 203 indicates the code for the country of the first carrier, namely the United States. Item 204 indicates the code for the first carrier, namely the United States Postal Service. Item 205 indicates the service classification of the mail, namely first class mail. Item 206 indicates the special services requested code of the first carrier, for example the code for "track and trace". Examples of other special services are delivery confirmation, registered mail, certified mail, insured mail, collect on delivery, recorded delivery, special delivery, special handling, parcel airlift, business reply mail, return receipt for merchandise, return receipt, postal money order, restricted delivery, and recorded delivery, etc. Item 207 indicates the UPC code of the contents of the mail. Item 208 indicates the size of the mail, namely 4×6×2. Item 209 indicates the weight of the mail, namely 4 ounces. Item 210 indicates the code for the country of the second carrier, namely the United Kingdom. Item 211 indicates the second carrier, namely the Royal Mail. Item 212 indicates the special services requested code of the second carrier, namely the code for track and trace. Item 213 indicates the total payment that is going to be charged to the meter. Item 25 indicates the date tag 28 was affixed to mail 20. Item 19 indicates the unique number that is stored in tag 28 that uniquely identifies mail 20.

Figure 5:
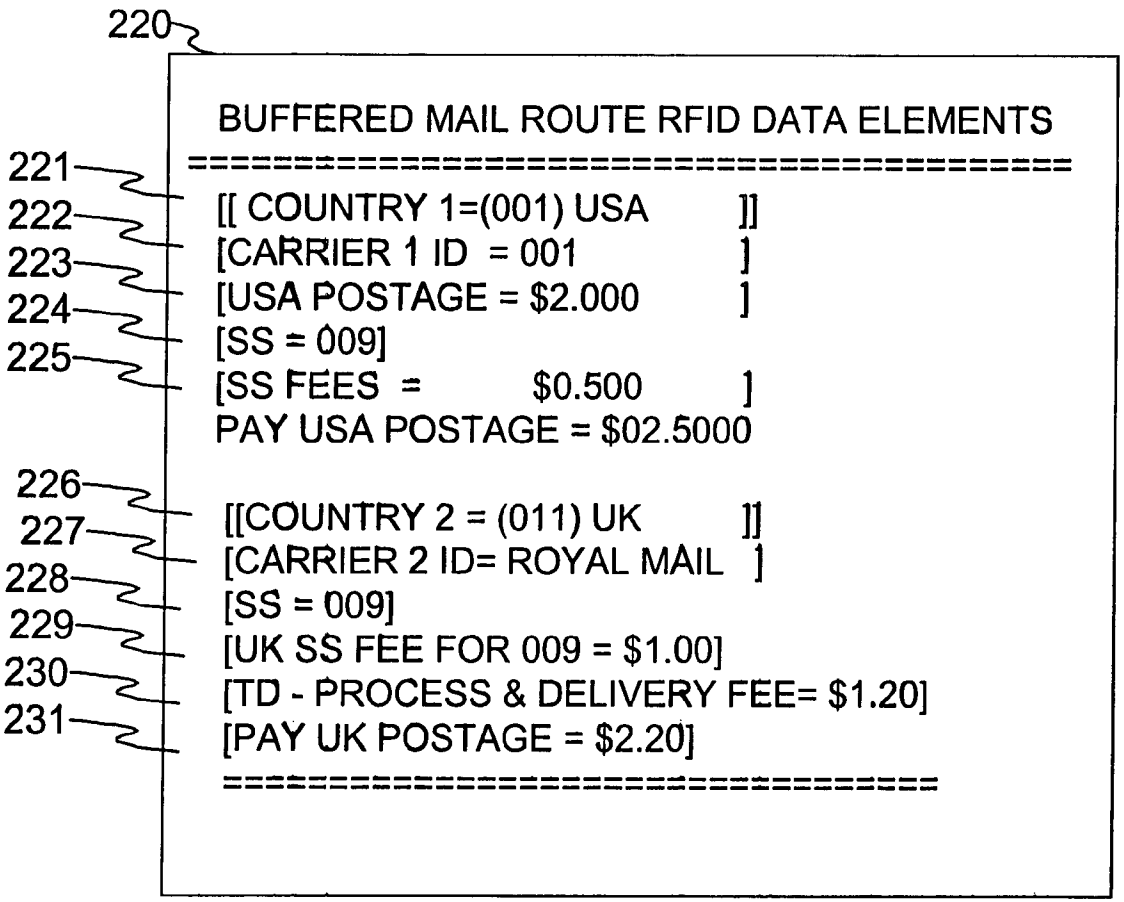
FIG. 5 is a drawing of the information stored in buffer 166.

FIG. 5 is a drawing of the information stored in buffer 166 as buffered mail route radio frequency identification data elements 220. Item 221 indicates the code for the country of the first carrier, namely the United States. Item 222 indicates the code for the first carrier, namely the United States Postal Service. Item 223 indicates part of the amount of United States postage. Item 224 indicates the special services requested code of the first carrier, namely the code for track and trace. Item 225 indicates the special services fee of the first carrier, namely $0.50. Item 226 indicates the amount of United States postage, namely $2.50. Item 227 indicates the code for the country of the second carrier, namely the United Kingdom. Item 228 indicates the second carrier, namely the Royal Mail. Item 229 indicates the special services requested code of the second carrier, namely the code for track and trace. Item 230 indicates the fee for track and trace charged by the second carrier namely, $1.00. Item 231 indicates the terminal dues process and delivery fee of $1.20. Item 232 indicates the amount of United Kingdom postage, namely $2.20.

The above specification describes a new and improved method for controlling domestic and international mail. It is realized that the above description may indicate to those skilled in the art additional ways in which the principles of this invention may be used without departing from the spirit. Therefore, it is intended that this invention be limited only by the scope of the appended claims.

What is claimed is:

1. A method for paying for mail to be delivered from a sender in a first country to a recipient in a second country, comprising the steps of:

affixing a radio frequency identification tag to mail for the payment of the carrier fees for the first country; and the second country and printing, in the vicinity of the radio frequency identification tag, human readable information indicative that postage has been canceled.

2. The method claimed in claim 1, wherein: the radio frequency tag has a first portion for storing fees for the first country and a second portion for storing fees for the second country.

3. The method claimed in claim 1, wherein: one or more graphics are printed in the vicinity of the radio frequency identification tag.

4. The method claimed in claim 1, wherein the radio frequency tag contains a unique number that uniquely defines the mail.

5. The method claimed in claim 1, wherein the radio frequency identification tag stores the services requested by the mailer.

6. The method claimed in claim 5, wherein the radio frequency identification tag stores the payment for the requested services.

7. The method claimed in claim 1, wherein the radio frequency identification tag stores the mailer's name and address.

8. The method claimed in claim 1, wherein the radio frequency identification tag stores the recipient's name and address.

9. The method claimed in claim 1, further including the step of canceling the radio frequency tag.

* * * * *